US009205936B2

(12) United States Patent
Shannon

(10) Patent No.: US 9,205,936 B2
(45) Date of Patent: Dec. 8, 2015

(54) APPARATUS AND METHODS FOR FILLING BAGS

(71) Applicant: Hope For Tomorrow, LLC, Tooele, UT (US)

(72) Inventor: Rodrick G. Shannon, Tooele, UT (US)

(73) Assignee: HOPE FOR TOMORROW, LLC, Tooele, UT (US)

( * ) Notice: Subject to any disclaimer, the term of this patent is extended or adjusted under 35 U.S.C. 154(b) by 325 days.

(21) Appl. No.: 13/853,829

(22) Filed: Mar. 29, 2013

(65) Prior Publication Data

US 2013/0255829 A1 Oct. 3, 2013

Related U.S. Application Data

(60) Provisional application No. 61/618,067, filed on Mar. 30, 2012.

(51) Int. Cl.
*B65B 1/04* (2006.01)
*B65B 67/12* (2006.01)
*B65B 67/04* (2006.01)

(52) U.S. Cl.
CPC . *B65B 1/04* (2013.01); *B65B 67/04* (2013.01); *B65B 67/1205* (2013.01); *B65B 67/1211* (2013.01); *B65B 67/1238* (2013.01)

(58) Field of Classification Search
CPC ..... B65B 1/04; B65B 67/04; B65B 67/12; B65B 67/1205; B65B 67/1211; B65B 67/1238
USPC ..... 141/108, 109; 294/49, 176, 178
See application file for complete search history.

(56) References Cited

U.S. PATENT DOCUMENTS

| | | | | |
|---|---|---|---|---|
| 2,629,624 | A * | 2/1953 | Nelles | 294/57 |
| 4,149,745 | A * | 4/1979 | Willis | 294/1.4 |
| 5,395,147 | A * | 3/1995 | Brown et al. | 294/178 |
| 6,131,971 | A | 10/2000 | Chen | |
| 6,378,577 | B1 * | 4/2002 | Piner et al. | 141/391 |
| 7,665,489 | B1 * | 2/2010 | Smith | 141/108 |
| 7,946,637 | B1 * | 5/2011 | Gehman et al. | 294/54.5 |
| 8,641,109 | B2 * | 2/2014 | Ng | 294/1.4 |
| 2011/0011492 | A1 | 1/2011 | Shahbazian | |

OTHER PUBLICATIONS

Teti, Kevin, Quicksandbagger Hope for Tomorrow flood prevention, YouTube, Mar. 17, 2014, https://www.youtube.com/watch?v=0m4yHn_zkHg.

International Search Report and Written Opinion mailed Jul. 1, 2015 for PCT/US2015/024247.

* cited by examiner

*Primary Examiner* — Timothy L Maust

(74) *Attorney, Agent, or Firm* — R. Whitney Johnson; Stoel Rives LLP

(57) ABSTRACT

Apparatus and methods for filling a bag are provided. The apparatus includes a shovel with an elongate shovel arm, a shovel mouth positioned at a distal end of the shovel arm, and a shovel handle positioned at a proximal end of the shovel arm. The shovel mouth collects and directs fill material into the bag. The shovel handle is inserted into an opening of the bag and grasped by a user toward a bottom portion of the bag and from outside the bag. The apparatus includes an elongate arm rotatably coupled to the shovel arm at a pivot point and extending distally at an angle away from the shovel arm. The elongate arm rotates between an insertion configuration, in which the apparatus has a low profile for easy insertion into a bag, and an operable configuration to hold the bag open during filling.

19 Claims, 8 Drawing Sheets

APPARATUS AND METHODS FOR FILLING BAGS

RELATED APPLICATIONS

The present application claims benefit of priority under 35 U.S.C. §119(e) of U.S. Provisional Patent Application No. 61/618,067, filed Mar. 30, 2012, and entitled "APPARATUS AND METHODS FOR FILLING BAGS," which is hereby incorporated herein by reference in its entirety.

TECHNICAL FIELD

The present disclosure is directed to apparatus and methods for filling bags, and particularly to filling sand bags.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION OF PREFERRED EMBODIMENTS

Figure 1:
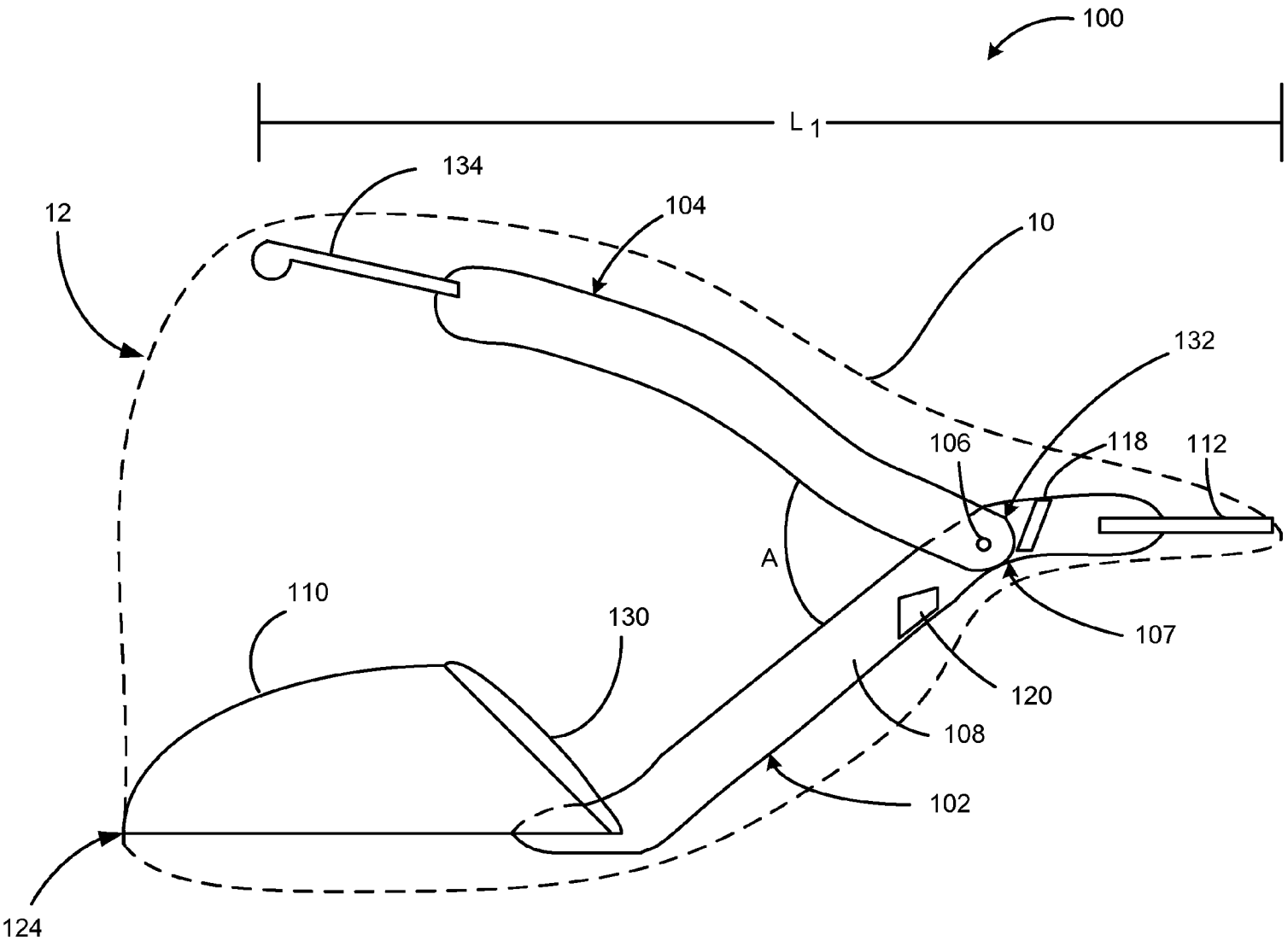
FIG. 1 is a side view of a bagging apparatus inserted into a bag, according to one embodiment.
Figure 2A:
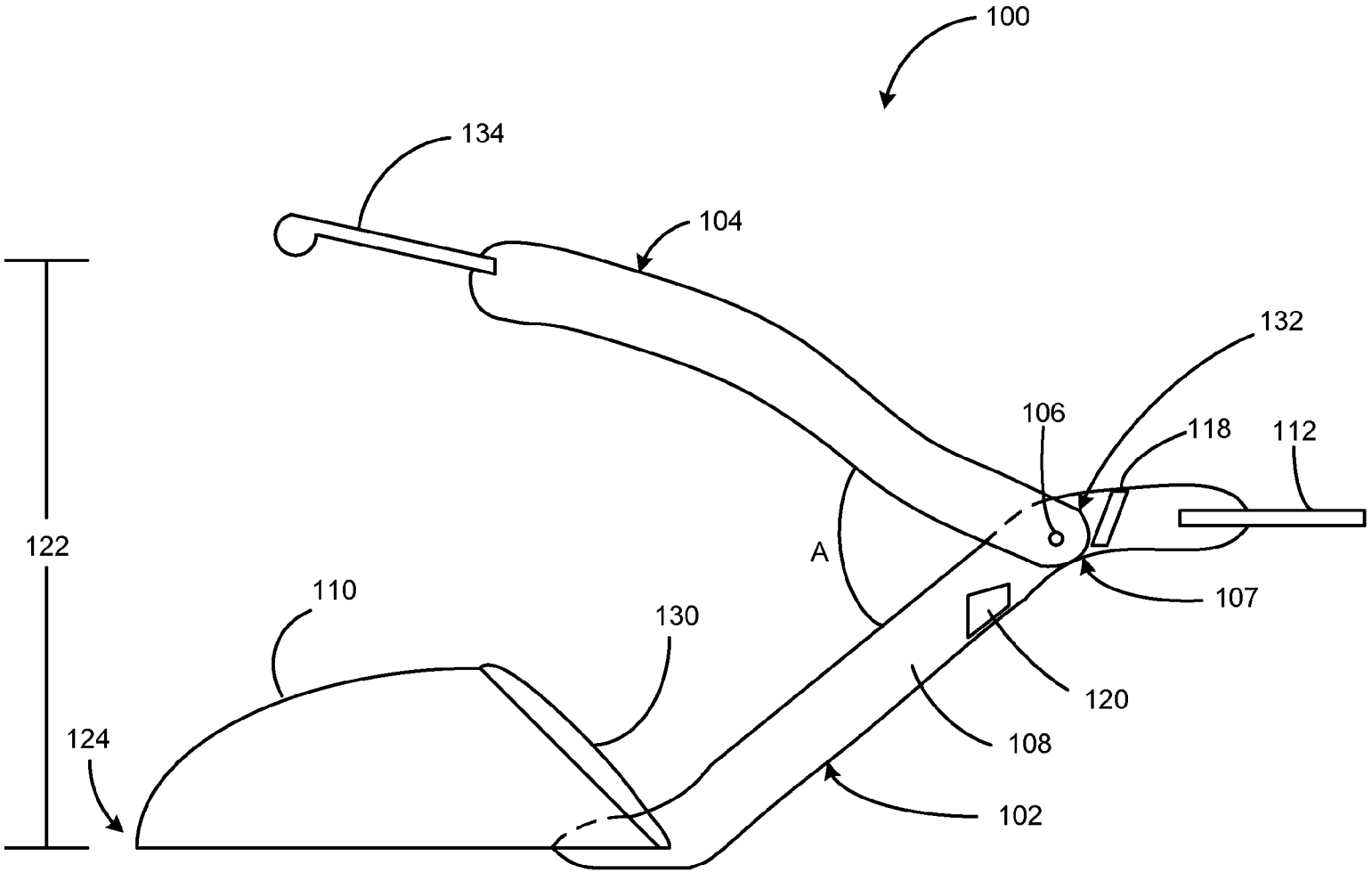
FIG. 2A is a side view of a bagging apparatus in an operable configuration, according to one embodiment.
Figure 2B:
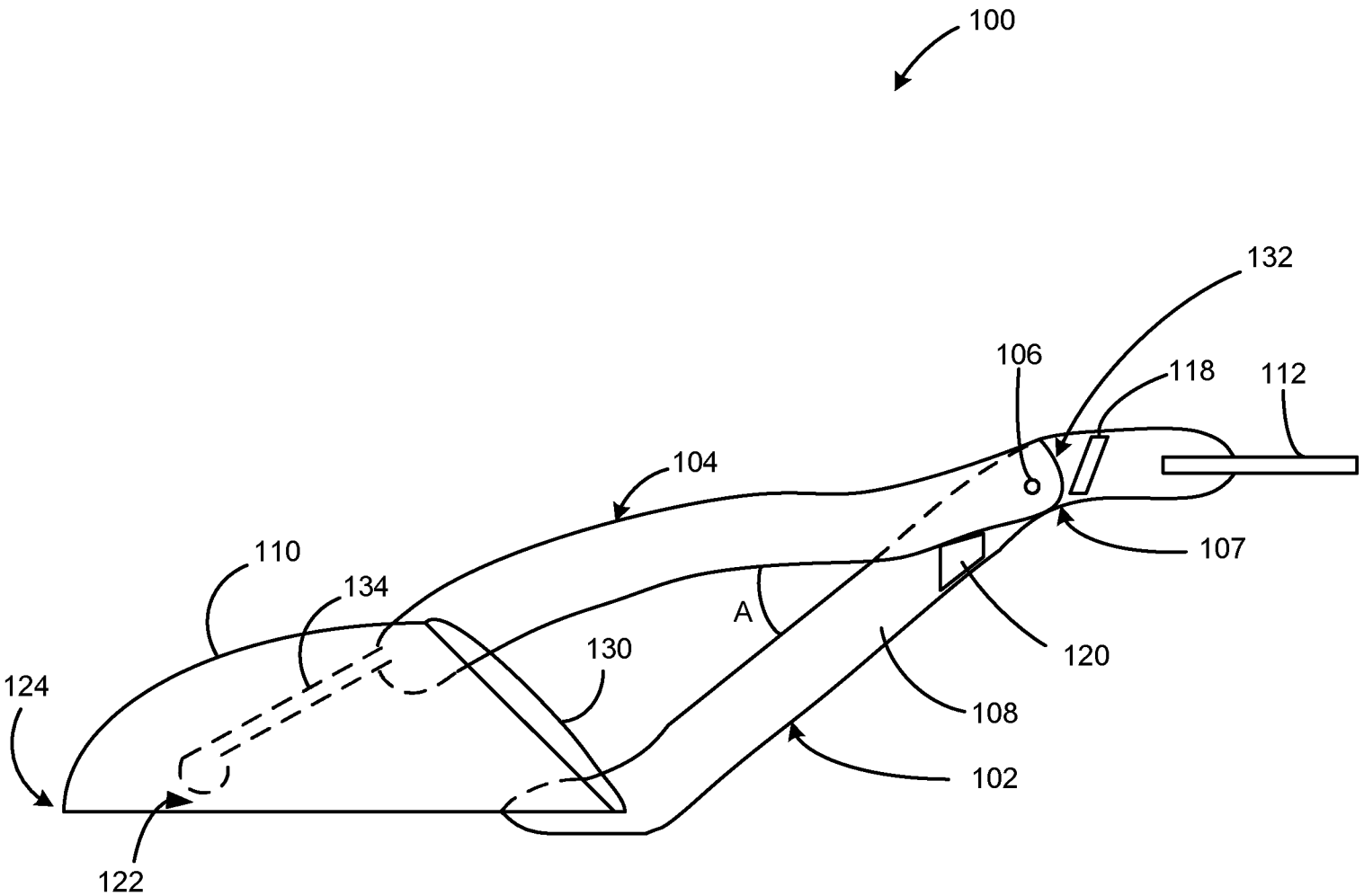
FIG. 2B is a side view of a bagging apparatus in an insertion configuration, according to one embodiment.

Flooding resulting from weather, rising water, and natural disasters is a perpetual threat to structures, property, and life, among other things. During times of flooding, or threatened flooding, relief agencies and volunteers mobilize to erect barriers to halt and/or redirect advancing flood waters, for example, to protect structures, property, and life. Time is critical and individuals strive to work quickly to erect barriers to redirect or hold the flood waters at bay. Sandbags are often filled and used to erect temporary barriers.

Sandbags are also used in other situations, such as military operations and combat, to erect temporary barriers.

Traditionally, sandbags have been filled by cooperation of two individuals. A first person holds the bag while a second person uses a traditional shovel to scoop sand or other fill material into a bag. The process to fill bags in this manner is arduous and time consuming as multiple shovels full of material are typically needed to fill a bag. The process is also inefficient because two individuals are required to fill a single bag. Filling bags with a traditional shovel simply is not well suited for situations when moments can mean the difference between successfully containing flood waters or loss of, for example, property and/or life.

Machines developed to improve the process are expensive and in some circumstances impractical or impossible to use. Existing devices developed to improve the efficiency of the process hardly reduce the labor required. These devices require that the material be raised to a height above an opening of the bag to allow the material to fall into the bag, and thus the design of these existing devices is not ergonomic and does not reduce or minimize physical effort and discomfort.

The present disclosure is directed to apparatus and methods for filling bags in an ergonomic and efficient manner. A bagging apparatus in an insertion configuration may be inserted into a sand bag and then moved to an operable configuration that allows the user to use a scooping motion to fill the bag. The bagging apparatus may include two handles and a bagger shovel. The handles and bagger shovel may be configured to be positioned within the bag during filling, which allows the user to simultaneously grasp the bag and the handles. After the bag is filled, the device can easily be removed from the bag with an upward motion, or by applying an upward force.

The disclosed apparatus and methods may enable a single individual to fill a bag with fill material. The bagging apparatus, because it may be positioned inside the bag, or mostly inside the bag, may support a length of the bag during filling. A user may grasp both the bagging apparatus and the bag with both hands during filling. The apparatus and methods may also reduce the height to which the fill material is lifted by a user to fill the bag.

Although the present disclosure is provided with frequent reference to sand bags, bagging as described herein is not limited to sand bags. Other bagging applications are relevant and the disclosed embodiments can be used for other bagging applications and are not limited to sand bagging. For example, fill material is not limited to aggregate, such as sand, gravel, soil, etc., but may also include materials such as grains, seeds, nuts, salt, mulch, compost, and any of a variety of materials that may be put into, stored in, and/or transported in a bag.

Embodiments may be best understood by reference to the drawings, wherein like parts are designated by like numerals throughout. It will be readily understood that the components of the present disclosure, as generally described and illustrated in the drawings herein, could be arranged and designed in a wide variety of different configurations. Thus, the following more detailed description of the embodiments of the apparatus is not intended to limit the scope of the disclosure, but is merely representative of possible embodiments of the disclosure. In some cases, well-known structures, materials, or operations are not shown or described in detail.

Figure 3:
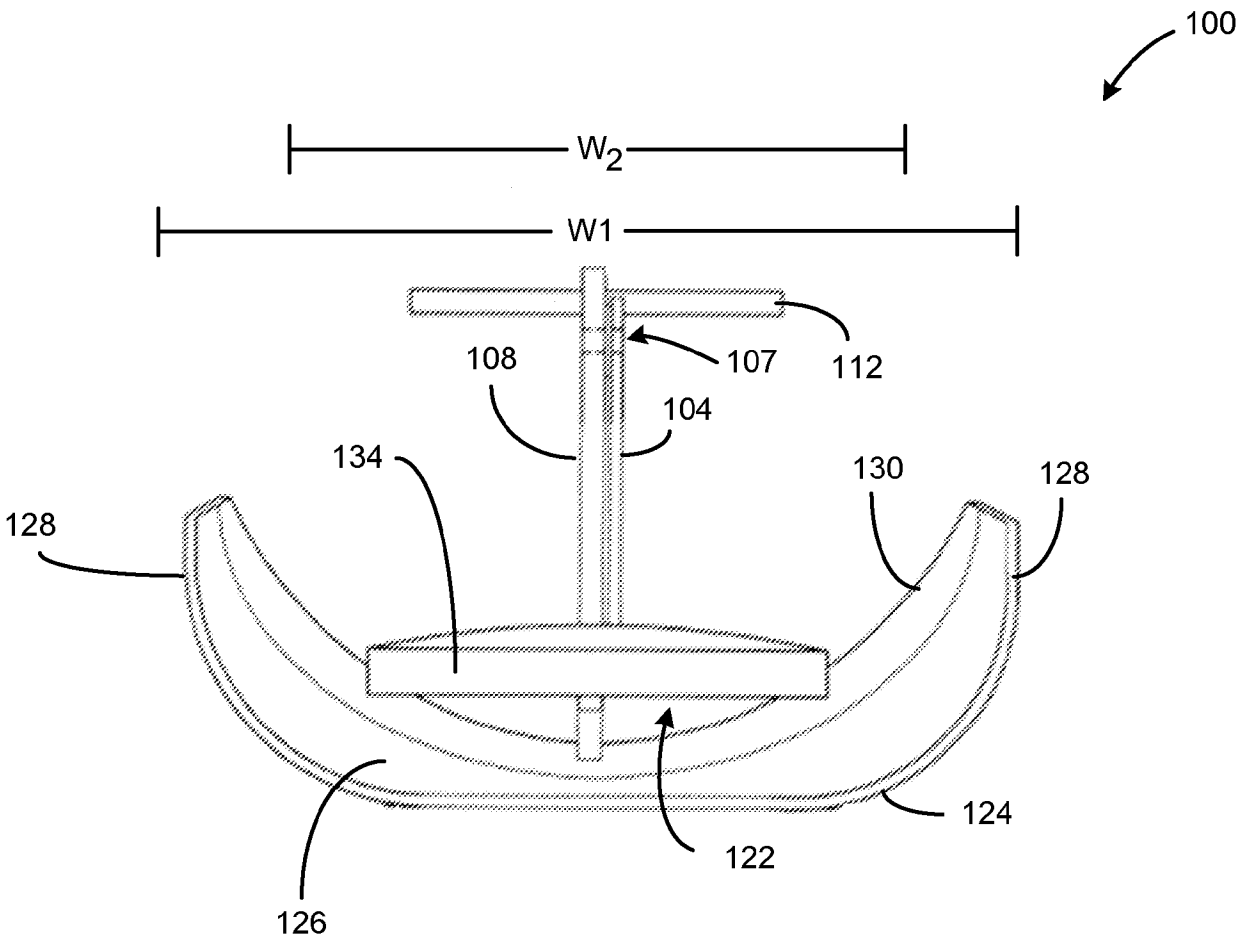
FIG. 3 is an end view of a bagging apparatus, according to one embodiment.
Figure 4:
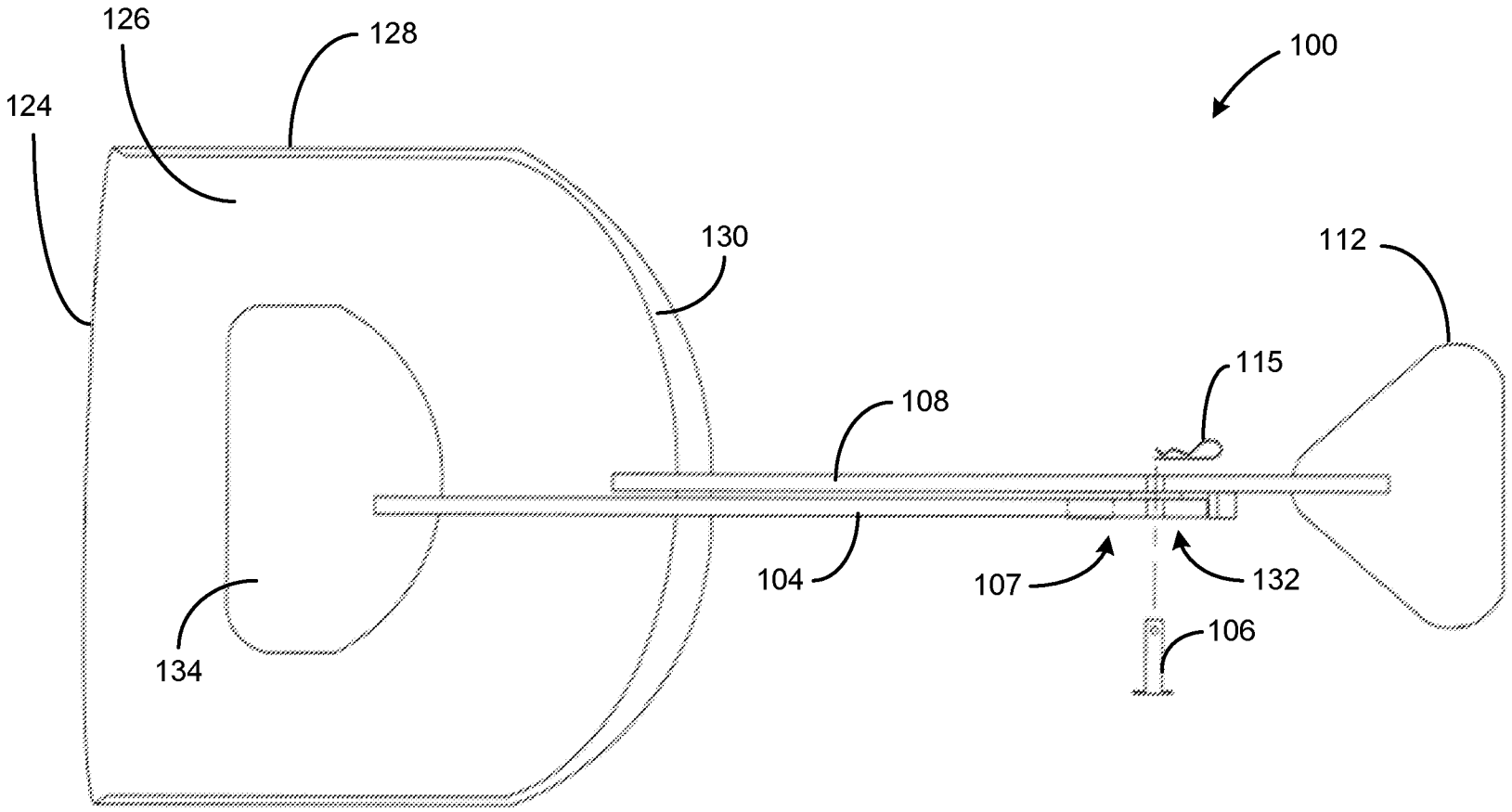
FIG. 4 is a top view of a bagging apparatus, according to one embodiment.

FIGS. 1-4 are various views of a bagging apparatus 100, according to one embodiment. FIG. 1 is a side view of the bagging apparatus 100 inserted into a bag 10. FIG. 2A is a side view of the bagging apparatus 100 in an operable configuration. FIG. 2B is a side view of the bagging apparatus 100 in an insertion configuration. FIG. 3 is an end view of the bagging apparatus 100. FIG. 4 is a top view of the bagging apparatus 100. The bagging apparatus 100 may comprise a bagger shovel 102 and a bagger arm 104 coupled to and extending from the bagger shovel 102.

Figure 5:
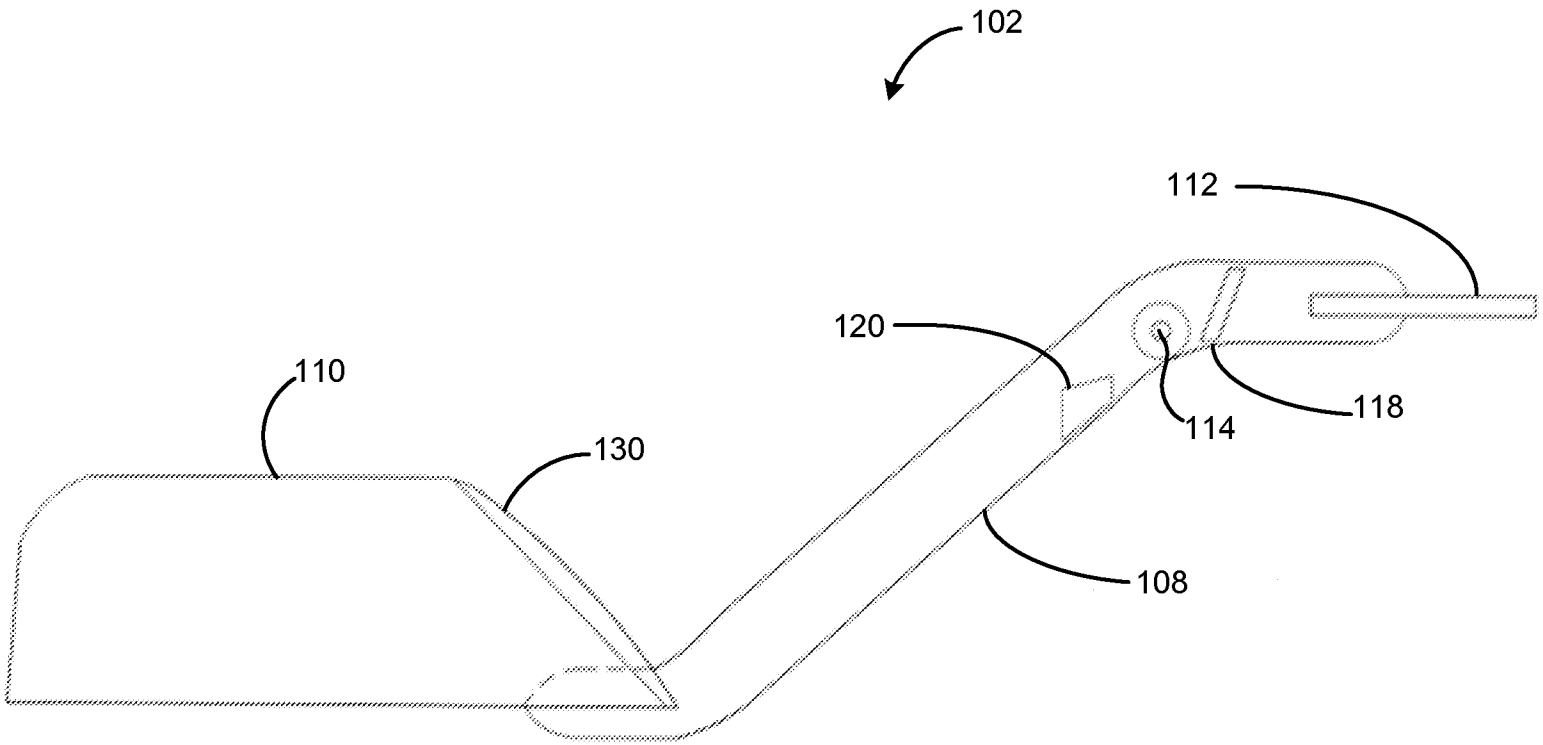
FIG. 5 is side view of a bagger shovel of a bagging apparatus, according to one embodiment.
Figure 6:
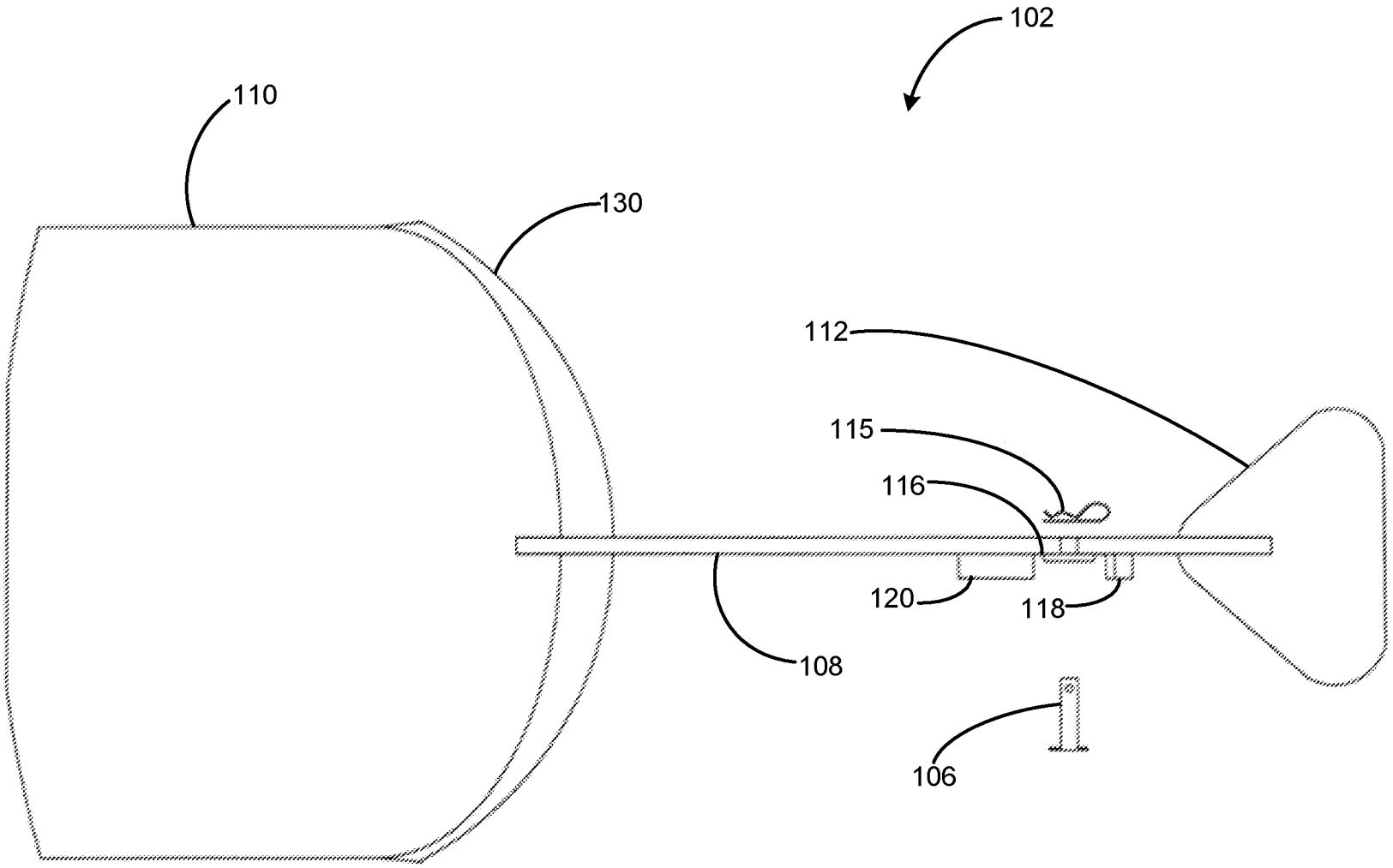
FIG. 6 is top view of a bagger shovel of a bagging apparatus, according to one embodiment.

FIGS. 5-6 illustrate a bagger shovel 102 of a bagging apparatus, according to one embodiment. FIG. 5 is side view of the bagger shovel 102 of a bagging apparatus. FIG. 6 is top view of the bagger shovel 102 of a bagging apparatus.

Figure 7:
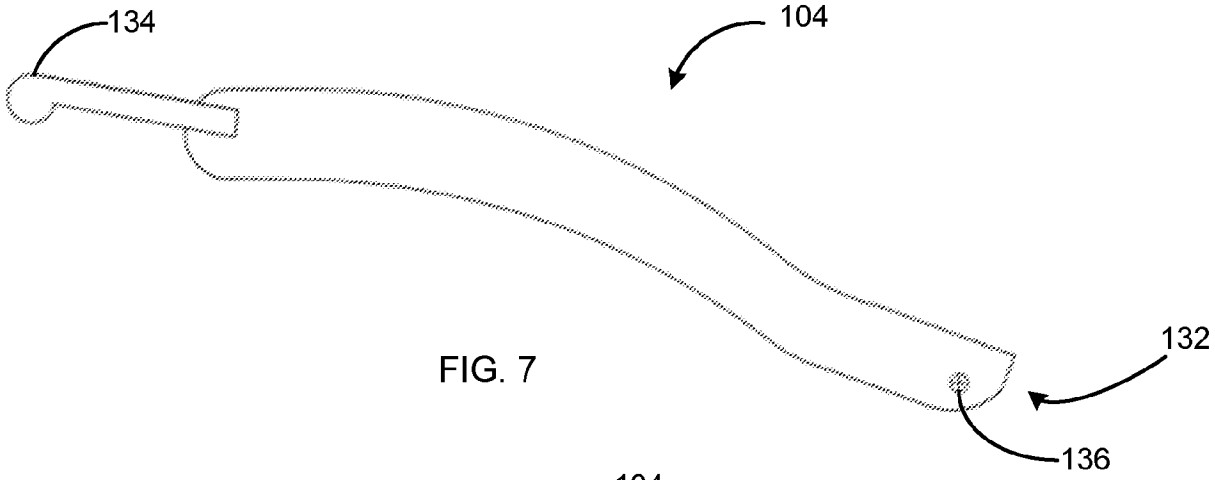
FIG. 7 is a side view of a bagger arm of a bagging apparatus, according to one embodiment.
Figure 8:
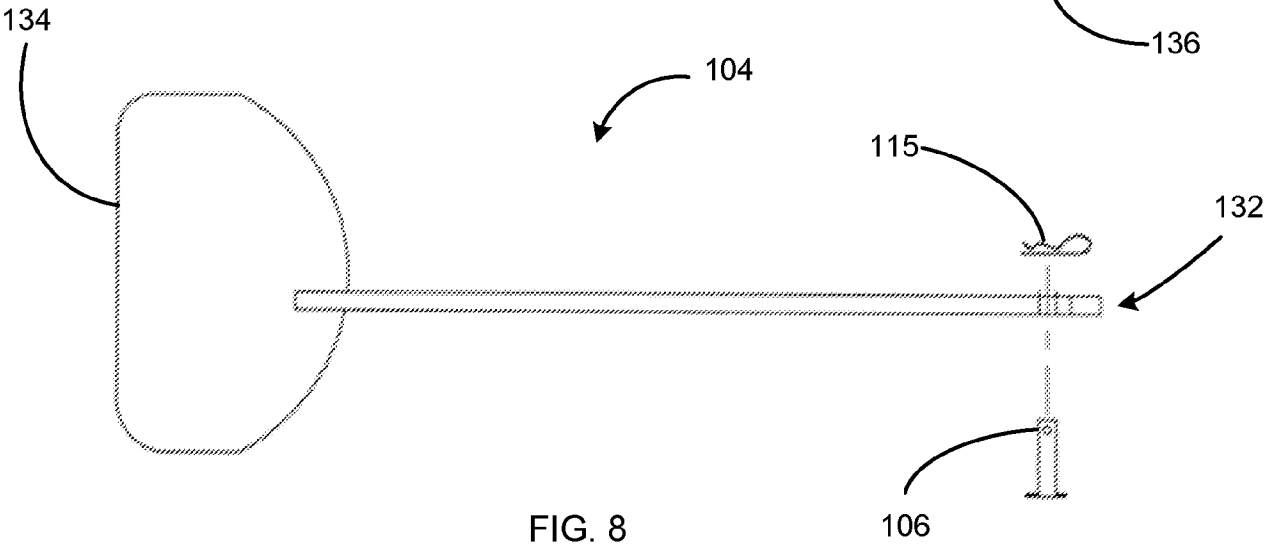
FIG. 8 is a top view of a bagger arm of a bagging apparatus, according to one embodiment.

FIGS. 7-8 illustrate a bagger arm 104 of a bagging apparatus, according to one embodiment. FIG. 7 is a side view of the bagger arm 104 of a bagging apparatus. FIG. 8 is a top view of the bagger arm 104 of a bagging apparatus.

Referring generally and collectively to FIGS. 1-8, the illustrated bagging apparatus 100 includes a bagger shovel 102 and an elongate bagger arm 104 rotatably coupled together by a pin 106 or other coupling device at a pivot point 107. Rotatably coupling the bagger shovel 102 and the bagger arm 104 allows the bagger arm 104 to rotate at the pivot point 107 relative to the bagger shovel 102, between an operable configuration (shown in FIG. 2A) and an insertion configuration (shown in FIG. 2B). In the insertion configuration, the bagger arm 104 is positioned more proximate to the bagger shovel 102 than in the operable configuration, thereby enabling easy insertion of the bagging apparatus 100 into a bag (shown in FIG. 1). The pivot point 107 is positioned proximate to a middle portion of the bagger shovel 102.

The bagger shovel 102 (shown isolated in FIGS. 5-6) may include a shovel arm 108 having a shovel mouth 110 positioned at a first end (e.g., a distal end) and a shovel handle 112 at a second end (e.g., a proximal end). The shovel arm 108 may be a rigid elongate shaft having sufficient strength and rigidity to transfer force applied to the shovel handle 112 to the shovel mouth 110. Accordingly, a force applied to the shovel handle 112 in a direction toward the shovel mouth 110 may cause the shovel mouth to be propelled in the same direction, for example, to scoop fill material.

The shovel arm 108 may further include a pivot hole 114 (shown in FIG. 5) at the pivot point 107 to receive the pin 106 or other coupling device to couple the bagger shovel 102 to the bagger arm 104. The pivot hole 114 may be positioned near the middle of the shovel arm 108, between the proximal and distal ends of the shovel arm 108. The pin 106 or other coupling device rotatably couples the bagger arm 104 to the bagger shovel 102. A spacer 116 may be positioned adjacent to or around the pivot hole 114 to enhance rotatability of the bagger arm 104 relative to the bagger shovel 102. The pin 106 is positioned through the pivot hole 114 and may be secured in place with a retaining clip 115. As can be appreciated, in other embodiments the pin 106 may be substituted for any suitable coupling device or mechanism, such as a rivet, a nut and a bolt, a fixed pin, or a molded pivot point. As can also be appreciated, in other embodiments the pin 106 may be integral with one of the shovel arm 108 or the bagger arm 104 and configured to mate with a pivot hole on the other.

An upper stop 118 and a lower stop 120 may be positioned proximate to the pivot hole 114 and configured to limit a rotational range of the bagger arm 104 relative to the bagger shovel 102. The upper stop 118 may limit rotation of the bagger arm 104 away from the bagger shovel 102 to the operable configuration. The upper stop 118 is secured to the shovel arm 108 and is sufficiently rigid such that, when the bagger arm 104 is in contact with the upper stop 118, a force on the bagger arm 104 in a direction away from the bagger shovel 102 is transferred to the bagger shovel 102. The lower stop 120 may limit a rotational range of the bagger arm 104 toward the bagger shovel to the insertion configuration. In the insertion configuration, a gap 122 (or distance 122) between the bagger shovel 102 and the bagger arm 104 may allow a user to grasp a handle 134 of the bagger arm 104, as discussed in more detail below.

The shovel mouth 110 may be configured in the shape of a scoop or similar device. The shovel mouth 110 may comprise a blade 124, a scoop area 126 (or bottom), and two sides 128. The blade 124 is positioned at a distal end of the shovel mouth (also the leading edge) and may be shaped and configured to contact and gather fill material into the scoop area 126. In the illustrated embodiment, the blade 124 is straight to provide a square point configuration to scoop loose material. The blade 124 and scoop area 126 are sized and configured to fit within the bag 10 being filled and to be positioned proximate to the bag opening 12 (or mouth). In particular, a width $W_1$ of the shovel mouth 110 is smaller than a width of the opening 12 of the bag 10, so as to allow the shovel mouth 110 to fit inside the opening 12 of the bag 10. The sides 128 aid to expand the opening 12 of the bag 10 during insertion of the bagging apparatus 100 into the bag 10. The sides 128 also aid in receiving and directing the fill material scooped into the shovel mouth 110 toward the bottom of the bag 10.

The shovel mouth 110, in some embodiments, may include a deflector 130 positioned at the proximal end of the shovel mouth 110. The deflector and may reduce or limit snagging of the bag on the shovel mouth 110 as the bagging apparatus 100 is inserted into the bag 10. The deflector 130 is also configured to allow fill material to pass over it during scooping, allowing the fill material to pass toward the bottom of the bag 10.

The shovel mouth 110 in the illustrated embodiment is fixedly coupled to the shovel arm 108. As can be appreciated, in other embodiments the shovel mouth 108 may be removably coupled to the shovel arm 108 to facilitate easy and convenient storage and/or transport of the bagging apparatus 100. Also, as can be appreciated, other configurations of the blade 124 are possible, such as to provide a round point configuration for digging and loosening material.

The shovel handle 112 is positioned at the proximal end of the shovel arm 108 and is configured to be grasped by a hand of a user, from outside (and through) the bag 10. Accordingly, the user grasps the shovel handle 112 and the bag 10 simultaneously. The shovel handle 112 may have a width $W_2$ that is smaller (potentially much smaller) than the width $W_1$ of the shovel mouth 110 so as to easily lead and guide the bagging apparatus 100 through the opening 12 of the bag 10 and into the bag 10 during insertion. The shovel handle 112 is configured to be positioned more toward the bottom of the bag 10 relative to the shovel mouth.

The bagger arm 104 may be an elongate shaft configured to be coupled to, and extend away from, the bagger shovel 102. The bagger arm 104 includes a pivot hole 136 to receive the pin 106 and form the pivot point 107. The bagger arm 104 is configured to extend distally at an angle A to the shovel arm 108 from the pivot point 107. In other words, the bagger arm 104 may extend both longitudinally in the direction the bagger shovel 102 extends (e.g. in a distal direction) and laterally away from the bagger shovel 102. In the insertion configuration, the angle A may be relatively small, for example between about five degrees and about thirty degrees. In the operable configuration, the angle A may be larger, for example in the range of about thirty degrees and about one hundred degrees. In some embodiments, the angle A in the operable configuration may be between thirty-five degrees and ninety-five degrees. In some embodiments, the angle A in the operable configuration may be between forty degrees and ninety degrees. In some embodiments, the angle A in the operable configuration may be between forty-five degrees and eighty-five degrees. In some embodiments, the angle A in the operable configuration may be between fifty degrees and eighty degrees. In some embodiments, the angle A in the operable configuration may be between fifty-five degrees and seventy-five degrees. In some embodiments, the angle A in the operable configuration may be between sixty degrees and seventy degrees. In one embodiment, the rotational range of the bagger arm 104 (i.e., the range of angle A) is approximately forty degrees.

As described, the bagger arm 104 may be rotatably coupled to the bagger shovel 102 and rotates between an insertion configuration and an operable configuration. A proximal end 132 (or proximal portion) of the bagger arm 104 of the illustrated embodiment is configured to abut against the upper stop 118 in the operable configuration and to abut against the lower stop 120 in the insertion configuration. As can be appreciated, in other embodiment, the bagger arm 104 and/or the stops 118, 120 may be configured differently, such that a proximal portion of the bagger arm 104 positioned past the pivot point 107 abuts the lower stop 120 in the operable configuration and abuts the upper stop 118 in the insertion configuration.

The bagger arm 104 may further comprise a bagger arm handle 134 positioned at a distal end of the bagger arm 104. The bagger arm handle 134 rotates in the gap 122. In the insertion configuration, the gap 122 (or distance 122) between the shovel mouth 110 and the bagger arm handle 134 is relatively small, perhaps only sufficiently wide to allow a hand of a user to grasp the bagger arm handle 134 to hold the bagging apparatus 100 during insertion into the bag 10. In the operable configuration, the gap 122 (or distance 122) between the shovel mouth 110 and the bagger arm handle 134 is larger so as to prop open the mouth 12 of the bag 10 for easy filling. A length $L_1$, between the bagger arm handle 134 (positioned toward the distal end of the bagging apparatus 100) and the shovel handle 112 (positioned toward the proximal end of the bagging apparatus), is a length of the bag 10 that is supported by the bagging apparatus during operation (e.g., filling the bag).

The bagging apparatus 100 may be formed of a rigid plastic material that may be injection molded and/or laser-cut to a desired shape. As can also be appreciated, the bagging apparatus may be formed of any appropriately rigid material, such as a material sufficiently rigid to hold its shape during scooping aggregate material, for example aluminum, other types of metal and/or metal alloy, wood, and fiberglass.

Use of the bagging apparatus 100 is now described. With the bagging apparatus 100 in the insertion configuration, the shovel handle 112 may be inserted into an empty bag (e.g., a sandbag), toward the bottom or bottom portion, or closed end, of the bag 10. The shovel handle 112, now positioned within the bag 10, may be grasped, for example, by a user with one hand from without the bag 10, such that a wall of the bag 10 is positioned in between the shovel handle 112 and the hand holding (grasping) the shovel handle 112. In another embodiment, a mechanical apparatus may grip the shovel handle 112.

The deflector 130 may prevent the bag 10 from snagging on the shovel mouth 110 as the bagging apparatus 100 is inserted into the bag 10. The pin assembly, including the pin 106, the retaining clip 115, and the spacer 116, provides a hinge between the shovel arm 108 and the bagger arm 104. The stops 118, 120 restrict the range of motion of the bagger arm 104 and may allow for easy insertion of the bagging apparatus 100 into the empty bag 10.

The bagger arm handle 134 may also be positioned inside the bag 10, extending from the pivot point 107, toward a top portion of the bag to a position at or near the opening of the bag. The bagger arm handle 134 can be grasped by the user with the other hand at a position proximate the opening 12 of the bag 10. A lip of the bag 10 at the opening 12 may be wrapped around the bagger arm handle 134 to secure the bag 10 relative to the bagging apparatus. For example, a user may grasp the bagger arm handle 134 with a portion of the bag 10 positioned between the user's palm and the handle 134. The user's fingers may curl around the handle 134 and extend into the opening 12 of the bag 10. In other embodiments, a mechanical apparatus may grip the bagger arm handle 134, and simultaneously grip a portion of the bag 10 against the bagger arm handle.

The shovel mouth 110 is also positioned inside the bag 10 with the blade 124 disposed at or proximate the opening 12 of the bag. In the operable configuration, the shovel mouth 110 and the bagger arm handle 134 may provide tension at the bag opening 12 to hold the bag 10 open. Rotating the bagger arm handle 134 about the pivot point 107 toward the shovel handle 112 configures the bagging apparatus in the operable configuration, opening the mouth 12 of the bag 10 and providing tension to the mouth 12 of the bag 10 to limit slippage of the bag 10 relative to the shovel mouth 110 during filling. The shovel mouth 110 is then scooped into aggregate (i.e., fill material, such as sand, gravel, dirt). For example, a user may stoop down and scoop the shovel mouth 110 into the aggregate. In another example, a machine may scoop the shovel mouth 110 into the aggregate. The handles 112, 134 provide grip and stability while the movement is executed to thereby fill the empty bag 10.

When the bag 10 is a third to half full, the bag 10 and bagging apparatus 100 can be tilted up to a vertical position and the bagging apparatus 100 can be pulled out of the bag 10. The weight of the filled bag 10 may allow the bagging apparatus 100 to easily slip out of the bag 10 (e.g., withdrawing from or through the fill material within the bag 10). The bagging apparatus 100 is removed from the full bag 10 by pulling on the bagger arm handle 134, for example with an upward motion. The low profile of the bagging apparatus 100, and narrow profile of the proximal end of the bagging apparatus, reduces drag (through the fill material within the bag 10) as the bagging apparatus 100 is removed from the filled bag 10. Using an upward motion to remove the bagging apparatus 100 may leave the filled bag standing. The bagging apparatus 100 is again ready for insertion into the next empty bag.

The bagging apparatus may enable the bag to be filled without raising any fill material to a height above the opening 12 of the bag 10. The bag 10 may be filled in a horizontal, or approximately horizontal, configuration and may be raised to a vertical configuration (e.g., for tying or otherwise closing the bag) without the fill material ever being raised to a vertical height above a vertical height of the opening 12 of the bag 10 when the bag is in a vertical (or approximately vertical) configuration or upright orientation greater than approximately 45 degrees vertical from level ground. In some embodiments, the upright orientation may be greater than approximately 60 degrees vertical from level ground. In some embodiments, the upright orientation may be greater than approximately 70 degrees vertical from level ground. In some embodiments, the upright orientation may be greater than approximately 80 degrees vertical from level ground.

When the pivot point 107 is positioned slightly lower than the line of the handles 112, 134, pressure inward will push the blade 124 of the bagger shovel 102 down (or lower) to facilitate scooping fill material. Also, because the blade 124 is lower than the handles 112, 134, the blade 124 will automatically pull the bag 10 open when resistance is applied. Tension from the bag 10 can hold the blade 124 and handles 112, 134 in place. The bag 10 may effectively become a part of the bagging apparatus 100 and of the mechanics of operating the bagging apparatus 100.

As can be appreciated, other embodiments of the invention are possible. Although the description above contains much specificity, these should not be construed as limiting the scope of the invention, but as merely providing illustrations of some of the presently preferred embodiments of this invention. The disclosure contemplates that various combinations or subcombinations of the specific features and aspects of the embodiments may be made and still fall within the scope of the present disclosure. Various features and aspects of the disclosed embodiments can be combined with or substituted for one another in order to form varying modes of the disclosed embodiments of the invention. Those having skill in the art will appreciate that many changes may be made to the details of the above-described embodiments without departing from the underlying principles of the invention. Thus, the scope of the present invention herein disclosed should not be limited by the particular disclosed embodiments described above.

Where a range of values is provided, it is understood that each intervening value, to the tenth of the unit of the lower limit unless the context clearly dictates otherwise, between the upper and lower limit of that range and any other stated or intervening value in that stated range is encompassed within the embodiments of the invention. The upper and lower limits of these smaller ranges which may independently be included in the smaller ranges are also encompassed within the embodiments disclosed, subject to any specifically excluded limit in the stated range. Where the stated range includes one or both of the limits, ranges excluding either or both of those included limits are also included in the embodiments of the invention.

What is claimed is:

1. An apparatus for filling a bag, the apparatus comprising:

a shovel comprising:

an elongate shovel arm, a shovel mouth positioned at a distal end of the shovel arm, and a shovel handle positioned at a proximal end of the shovel arm, wherein:

the shovel mouth is configured to collect and direct fill material into the bag, the shovel handle is configured to be inserted into an opening of the bag and grasped by a user toward a bottom portion of the bag and from outside the bag, and the shovel mouth is configured to be positioned at the opening of the bag, within the bag, and adjacent a first side of the opening of the bag during filling of the bag, when the shovel handle is positioned within the bag at a closed end of the bag;

an elongate bagger arm rotatably coupled to the shovel arm at a pivot point and extending at an angle in a distal direction and lateral direction away from the shovel arm, the bagger arm comprising a bagger arm handle disposed at a distal end; and an upper stop configured to limit a rotational range of the bagger arm away from the shovel mouth to an operable configuration in which the angle at which the bagger arm extends from the shovel arm is an acute angle, wherein the bagger arm rotates between an insertion configuration, in which the apparatus has a low profile with a first distance between the shovel mouth and the bagger arm handle, the low profile configured to facilitate insertion into a bag, and the operable configuration, in which the bagger arm handle is configured to be positioned within the bag adjacent a second and opposite side of the opening of the bag, creating a gap between the shovel mouth and the bagger arm handle and thereby holding the bag open during filling, the gap in the operable configuration having a second distance greater than the first distance.

2. The apparatus of claim 1, further comprising a pin assembly to rotatably couple the bagger arm to the shovel arm at the pivot point.

3. The apparatus of claim 1, wherein the upper stop is disposed on the shovel arm adjacent the pivot point.

4. The apparatus of claim 1, wherein the upper stop is disposed on the bagger arm adjacent the pivot point.

5. The apparatus of claim 1, further comprising a lower stop configured to limit a rotational range of the bagger arm toward the shovel to the insertion configuration and prevent the bagger arm handle from contacting the shovel mouth, wherein the angle at which the bagger arm in the insertion configuration extends in the distal direction from shovel arm is more acute than the acute angle of the operable configuration.

6. The apparatus of claim 5, wherein the lower stop is disposed on the shovel arm adjacent the pivot point.

7. The apparatus of claim 5, wherein the lower stop is disposed on the bagger arm adjacent the pivot point.

8. The apparatus of claim 1, the shovel comprising a blade at a distal end of the shovel mouth, the blade to contact and direct fill material into the shovel.

9. The apparatus of claim 1, wherein the angle at which the bagger arm extends away from the shovel arm is between one degree and twenty degrees in the insertion configuration and is between twenty degrees and fifty degrees in the operable configuration.

10. A method of filling a bag, comprising:

inserting a bagging apparatus in an insertion configuration into an opening of a bag, the bagging apparatus comprising:

a shovel including an elongate shovel arm, a shovel mouth positioned at a distal end of the shovel arm, and a shovel handle positioned at a proximal end of the shovel arm; and an elongate arm rotatably coupled to the shovel arm at a pivot point and extending from the pivot point distally at an angle away from the shovel arm, the elongate arm comprising an arm handle at a distal end;

positioning the shovel handle at a bottom portion of the bag;

grasping the shovel handle at the bottom portion of the bag, the shovel handle being disposed within the bag and being grasped from without the bag;

positioning the shovel mouth at the opening of the bag, within the bag, and adjacent a first side of the opening of the bag;

rotating the elongate arm of the bagging apparatus about a pivot point from the insertion configuration to an operable configuration to create a gap between the shovel mouth and the arm handle to hold the bag open during filling;

grasping the arm handle adjacent a second side of the opening of the bag that is opposite the first side of the opening; and scooping the shovel mouth into fill material, the shovel mouth directing fill material into the bag and allowing the fill material to pass into and at least partially fill the bag.

11. The method of claim 10, further comprising wrapping a lip of the bag at the opening around the arm handle to secure the bag relative to the bagging apparatus.

12. The method of claim 10, wherein positioning the shovel mouth of the bagging apparatus at the opening of the bag comprises positioning a blade of the shovel mouth proximate the opening of the bag.

13. The method of claim 10, wherein scooping the shovel mouth into the fill material to fill the bag comprises filling the bag in an approximately horizontal orientation.

14. The method of claim 10, further comprising:

releasing the grasp on the shovel arm handle; and tilting the arm handle, and also the bagging apparatus within the filled bag, up to an upright orientation to dispose the filled bag in an upright orientation.

15. The method of claim 14, further comprising withdrawing the bagging apparatus out of the bag.

16. The method of claim 15, wherein the withdrawing the bagging apparatus out of the bag comprises an upward motion to withdraw the shovel handle through the fill material within the bag.

17. The method of claim 10, wherein scooping the shovel mouth into the fill material to fill the bag comprises filling the bag without raising any fill material to a height above the opening of the bag.

18. An apparatus for filling a bag, the apparatus comprising:

a shovel comprising:

an elongate shovel arm, a shovel handle, and a shovel mouth, wherein:

the shovel handle is disposed at a first end of the shovel arm and is configured to be inserted into an opening of the bag and grasped by a user toward a bottom portion of the bag on the outside of the bag, and the shovel mouth is disposed at a second end of the shovel arm and is configured to be positioned at the opening of the bag, within the bag, and adjacent a first side of the opening of the bag during filling of the bag to collect and direct fill material into the bag;

an elongate bagger arm rotatably coupled to the shovel arm at a pivot point and including a bagger arm handle disposed at a second end of the bagger arm, wherein the bagger arm extends from the pivot point away from the shovel arm defining an angle between the bagger arm and the shovel arm and forming a gap between the shovel mouth and the bagger arm handle; and an upper stop configured to limit a rotational range of the bagger arm away from the shovel mouth to an operable configuration in which the angle at which the bagger arm extends from the shovel arm is an acute angle, wherein the bagger arm rotates between an insertion configuration, in which the apparatus has a low profile, in which the gap between the shovel mouth and the bagger arm handle is a first distance, and an operable configuration, in which the gap between the shovel mouth and the bagger arm handle has a second distance, that is greater than the first distance, wherein the bagger arm handle in the operable configuration is configured to be positioned within the bag adjacent a second and opposite side of the opening of the bag to thereby maintain the bag open during filling.

19. The apparatus of claim 18, further comprising:

a lower stop configured to limit rotation of the elongate arm toward the bagger shovel to prevent the bagger arm handle from contacting the shovel mouth.

* * * * *